United States Patent [19]

Derr et al.

[11] 4,080,397

[45] Mar. 21, 1978

[54] METHOD FOR UPGRADING SYNTHETIC OILS BOILING ABOVE GASOLINE BOILING MATERIAL

[75] Inventors: Walter R. Derr, Voorhees, N.J.; Joseph R. McClernon, Morrisville, Pa.; Stephen J. McGovern, Bellmawr; Fritz A. Smith, Haddonfield, both of N.J.

[73] Assignee: Mobile Oil Corporation, New York, N.Y.

[21] Appl. No.: 703,719

[22] Filed: Jul. 9, 1976

[51] Int. Cl.[2] ..... C07C 1/04; C10G 34/00

[52] U.S. Cl. ..... 260/676 R; 208/79; 208/88; 208/93; 208/120; 208/135; 260/449 R; 260/450

[58] Field of Search ..... 260/676 R, 449 R, 449 M, 260/449.5, 449.6, 450; 208/57, 64, 79, 88, 93

[56] References Cited

U.S. PATENT DOCUMENTS

| | | | |
|---|---|---|---|
| 2,740,804 | 4/1956 | Glazier | 260/450 |
| 2,752,382 | 6/1956 | Garrett et al. | 260/450 |
| 3,172,842 | 3/1965 | Paterson | 208/79 |
| 3,700,585 | 10/1972 | Chen et al. | 208/111 |
| 3,729,409 | 4/1973 | Chen | 208/135 |
| 3,760,024 | 9/1973 | Cattanach | 260/673 |
| 3,843,510 | 10/1974 | Morrison et al. | 208/111 |
| 3,928,483 | 12/1975 | Chang et al. | 260/668 R |
| 3,960,978 | 6/1976 | Givens et al. | 260/683.15 R |

OTHER PUBLICATIONS

Asinger, Paraffins Chemistry & Technology, Pergammon Press, N.Y. (1968) pp. 3,123-125,131,132,136,138.

*Primary Examiner*—C. Davis

*Attorney, Agent, or Firm*—Charles A. Huggett; Carl D. Farnsworth

[57] ABSTRACT

Upgrading of 350° F plus product of Fischer-Tropsch Synthesis is accomplished by hydrotreating the Fischer-Tropsch Synthesis product and selective cracking the hydrotreated material boiling above about 600° F. A product slate is recovered comprising LPG, gasoline, jet fuel, light and heavy oil fractions.

14 Claims, 2 Drawing Figures

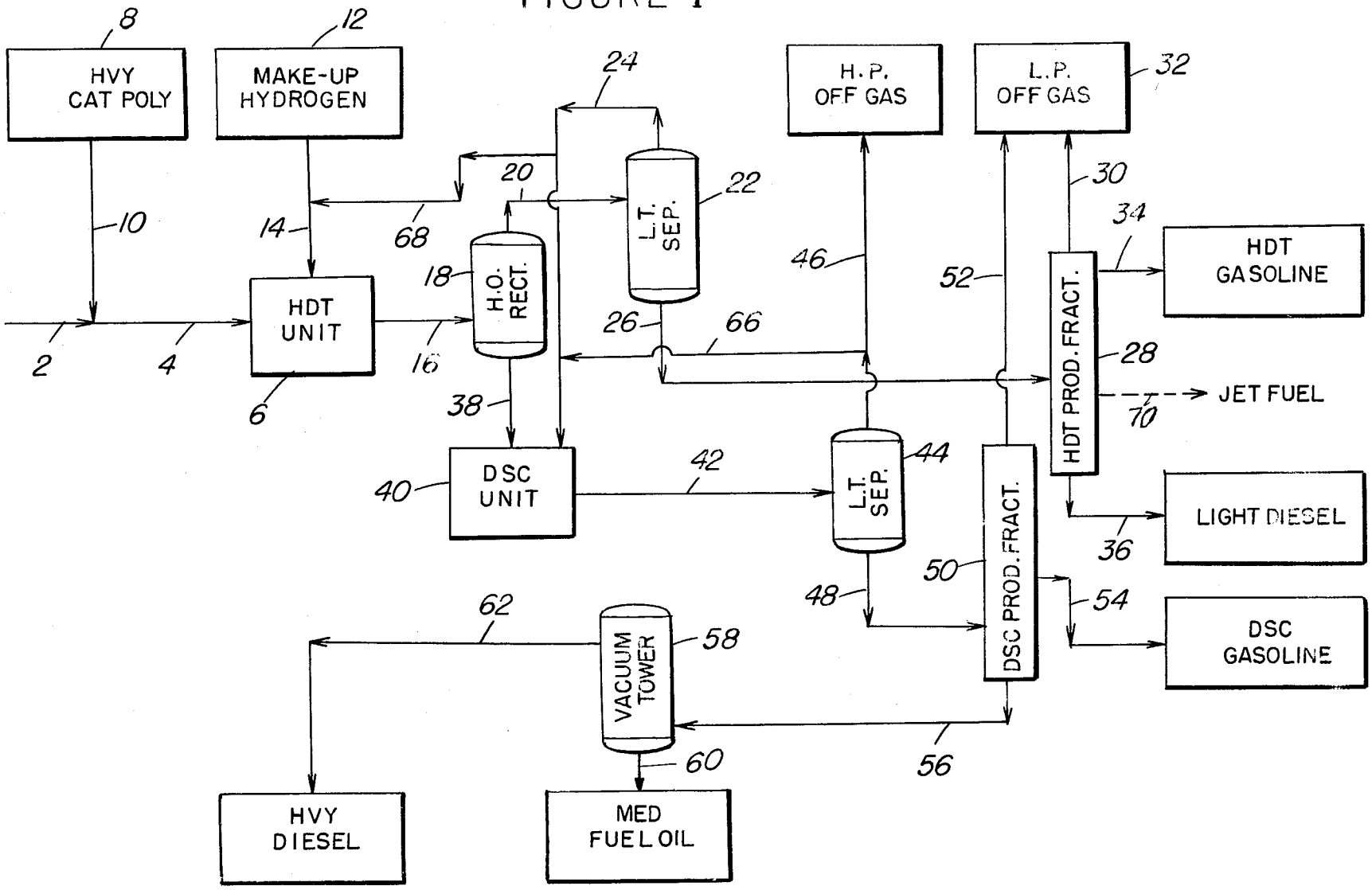
FIGURE I

FIGURE II
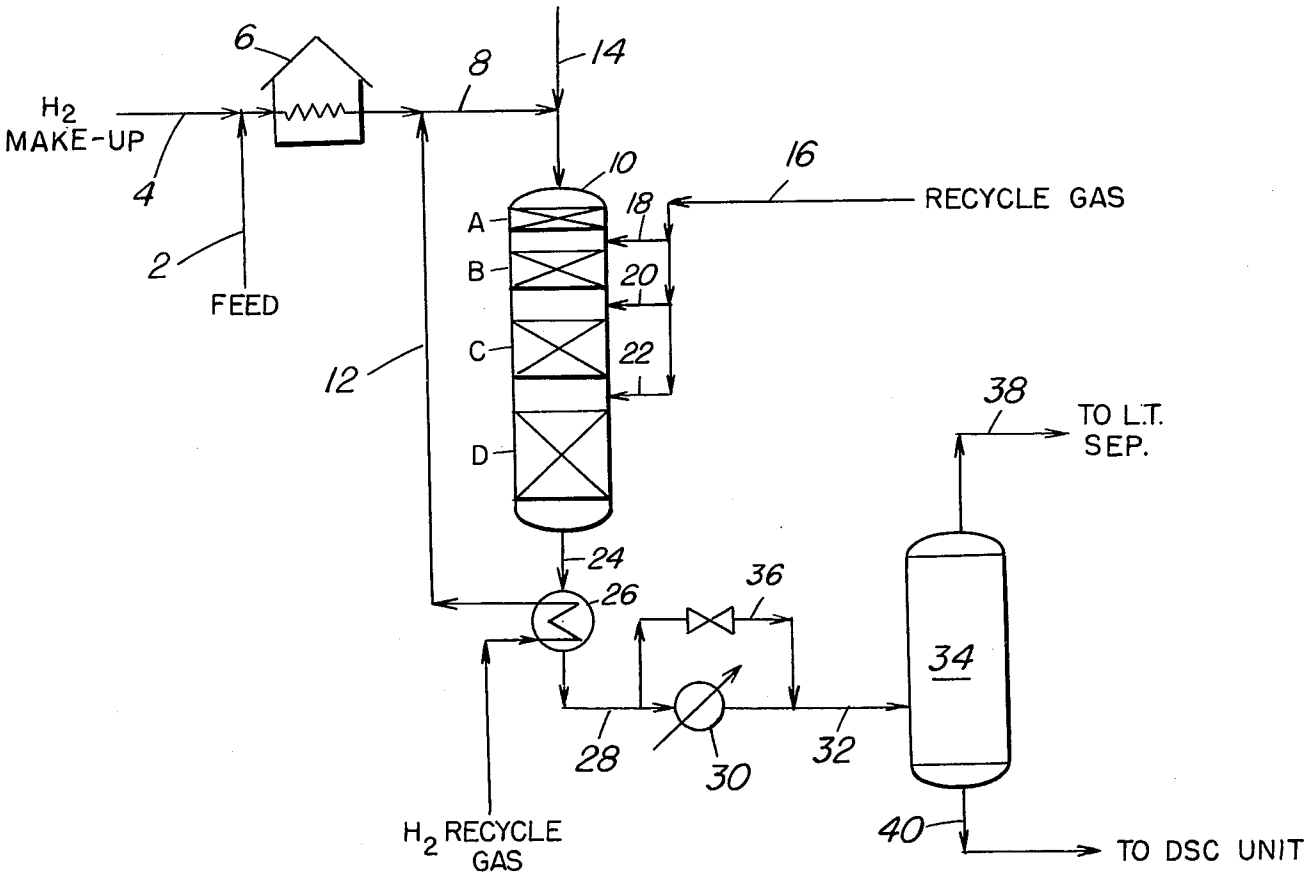

METHOD FOR UPGRADING SYNTHETIC OILS BOILING ABOVE GASOLINE BOILING MATERIAL

FIELD OF THE INVENTION

The invention relates to a method and process combination for upgrading synthetic oils such as coal-derived oils boiling generally above gasoline boiling range material. More particularly the present invention relates to upgrading products of FischerTropsch Synthesis and comprising hydrocarbons and oxygenates boiling above about 300° F and up to about 850° F or 975° F.

PRIOR ART

Processes for the conversion of coal and other hydrocarbons such as natural gas to a gaseous mixture consisting essentially of hydrogen and carbon monoxide, or of hydrogen and carbon dioxide, or of hydrogen and carbon monoxide and carbon dioxide, are well known. Although various processes may be employed for the gasification, those of major importance depend either on the partial combustion of the fuel with an oxygen-containing gas or on a combination of these two reactions. An excellent summary of the art of gas manufacture, including synthesis gas, from solid and liquid fuels, is given in Encylcopedia of Chemical Technology, Edited by Kirk-Othmer, Second Edition, Volume 10, pages 353–433, (1966), Interscience Publishers. New York, New York, the contents of which are herein incorporated by reference.

It is desirable to effectively and efficiently convert synthesis gas, obtained from coal, natural gas, or any other available source to highly valued hydrocarbons such as motor gasoline of relatively high octane number, diesel fuel, petrochemical feedstocks, liquefiable petroleum fuel gas, and aromatic hydrocarbons. It is well known that synthesis gas will undergo conversion to form reduction products of carbon monoxide, such as oxygenates and hydrocarbons, at a temperature in the range of about 300° F to about 850° F under pressure of from about one to one thousand atmospheres pressure, over a fairly wide selection of catalyst compositions. The Fischer-Tropsch process, for example, which has been most extensively studied, produces a range of products including oxygenates, heavy waxy oils, and liquid hydrocarbons which have been used as low octane gasoline. The types of catalysts that have been studied for this and related processes include those based on metals or oxides of iron, cobalt, nickel, ruthenium, thorium, rhodium and osmium.

The wide range of catalysts and catalyst modifications disclosed in the art and an equally wide range of conversion conditions used in the reduction of carbon monoxide by hydrogen contribute some flexibility toward obtaining a variety of different boiling-range products. Nonetheless, in spite of this flexibility, it has not proved possible to produce substantial quantities of liquid hydrocarbons in the gasoline boiling range which contain highly branched paraffins and substantial quantities of aromatic hydrocarbons, both of which are required for high quality gasoline, or to selectively produce aromatic hydrocarbons particulary rich in the benzene to xylenes range. A review of the status of this art is given in "Carbon Monoxide-Hydrogen Reactions", Encyclopedia of Chemical Technology, Edited by Kirk-Othmer, Second Edition, Volume 4, pp. 446–488, Interscience Publishers, New York, N.Y. the text of which is incorporated herein by reference.

SUMMARY OF THE INVENTION

This invention is concerned with a processing combination operation comprising a relatively mild hydrogenation of olefinic hydrocarbons in the presence of relatively high concentrations of oxygenates and boiling above 300° F and more usually within the range of about 400° F to about 915° F or 975° F. A heavy portion of the hydrogenated feed is thereafter subjected to selective cracking with one of a special group of crystalline zeolite catalysts. The present invention is particularly concerned with the method and means for upgrading carbon monoxide reduction products comprising oxygenates and hydrocarbons higher boiling than 300° F to produce high octane gasoline, light and heavy fuel oils of desired pour point.

In the combination operation of this invention, it is particularly contemplated processing a product of Fischer-Tropsch Synthesis comprising a mixture of a light oil boiling above 300° F or 325° F and higher boiling decant oil product boiling up to 850° or 975° F. Thus, the synthetic oil product processed by the combination of this invention to produce fuel oil product is higher boiling than gasoline and will contain a substantial portion of the higher boiling oxygenates formed in a Fischer-Tropsch Synthesis operation. It is also contemplated including with the feed, passed to the hydrogenation step, a portion of an olefinic product of catalytic polymerization boiling above about 370° F. Thus, it is contemplated processing as much as 20 volume percent of a heavy olefinic gasoline product of catalytic polymerization with the high boiling synthetic product of carbon monoxide reduction.

In one particular embodiment, it is contemplated within the scope of this invention of hydrotreating a blend of the aforesaid light oil and decant oil products of Fischer-Tropsch Synthesis boiling above about 400° F such as is particularly identified in Table 1 below.

TABLE 1

| DECANT OIL PROPERTIES | | |
|---|---|---|
| TBP Cut Point ° F | 400–890 (Measured) | 400–915 (Estimated) |
| Chemical Analysis | | |
| Sulfur, ppm | 40 | 45 |
| Nitrogen, ppm | <10 | 10 |
| Hydrogen % wt. | 12.68 | 12.6 |
| Oxygen, % wt. | 1.90 | 1.5 |
| Iron, ppm | 5.9 | 6.0 |
| Physical Properties | | |
| Gravity, ° API | 37.2 | 37.0 |
| Specific Gravity, 60/60° F | 0.8388 | 0.8398 |
| Molecular wt. | 250 | 251 |
| Pour Point ° F | 65 | 70 |
| Acid No., Mg KOH/gram | 2.99 | 2.9 |
| Bromine No. g Br/100 grams | 34.8 | 34.7 |
| Conf. Diolefins, M-moles/grams | 0.194 | 0.19 |
| Conradson Carbon, wt. % | 0.06 | 0.10 |
| Distillation ° F at IBP | 428 | 428 |
| 10% | 466 | 467 |
| 30% | 510 | 512 |
| 50% | 574 | 580 |
| 70% | 655 | 662 |
| 90% | 777 | 790 |
| 95% | 824 | 845 |
| Estimated E. P. | (890) | (915) |

In the hydrotreating operation of this invention, the reactions are generally quite mild but highly exothermic due to the rapid hydrogenation of olefins and oxygenates in the feed charged. Thus, hydrogen concentrations are required in the hydrotreating operation only sufficiently high to effect hydrogenation of olefins and oxygenates in combination with cooling of the products of the exothermic reaction encountered as with cool hydrogen rich recycle gas introduced between two or more spaced apart catalytic beds. A hydrogen requirement at the hydrogenation reactor inlet within the range of 1000 to 3000 SCF/bbl is contemplated. A total pressure within the range of 300 to 1200 psig at the hydrotreating reactor inlet is contemplated. A hydrogen partial pressure at the reactor outlet within the range of 200 to 1000 psia is also contemplated.

The hydrogenation catalysts particles employed in the fixed catalyst bed reactor system herein contemplated are sized to restrict pressure drop in the multiple catalyst bed reactor within predetermined desired limits. The catalyst comprises a mixture of cobalt and molybdenum on an alumina matrix material in a particular embodiment. The catalyst comprises about 6 wt. % cobalt and 12 wt. % of molybdena. The catalyst is a highly effective catalyst for the mild hydrotreating operation herein contemplated. However, other hydrogenation catalyst combinations may also be effectively employed such as nickel-molybdenum, nickel-cobalt-molybdena, nickel-tungsten and others known in the prior art distributed in suitable matrix material. In the hydrotreating operation, it is important to catalyst life that the hydrogen partial pressure be of a relatively high order of magnitude. More important, however, is the requirement that the catalyst be maintained in a sulfided condition. The synthetic feed prepared by Fischer-Tropsch Synthesis is relatively low in sulfur, usually in the range of about 30 ppm to 50 ppm weight. Therefore, it is important to not only presulfide the hydrogenation catalyst but also to maintain the sulfided state of the catalyt during mild hydrogenation by the continuous addition of a suitable sulfiding compound in a form providing sulfur in amounts within the range of 20 to 250 ppm weight based on feed.

In the hydrotreating operation of this invention, it has been found that the sulfur compounds in the feed are not sufficient by themselves to maintain the catalyst in a sulfided condition in the presence of the oxygenates and the hydrogen requirements of the process. Thus, a suitable sulfur activating compound must be added to the operation and in amounts providing at least 200 ppm sulfur in the separated off gas or hydrogen rich recycle gas.

During the hydrotreating (hydrogenation) operations herein discussed with oxygenates, olefins, and diolefins in the feed, hydrocarbonaceous material is deposited on the catalyst thereby operating to reduce the activity of the catalyst for accomplishing the results desired. Thus, when the catalyst acquires an amount of hydrocarbonaceous deposits undesirably affecting its catalytic activity, it then must be regenerated to remove the carbonaceous deposits. This is accomplished with oxygen containing gas such as one might obtain with a steam-air mixture, nitrogen-air mixtures or scrubbed flue gas enriched with oxygen at a pressure within the range of 50 to 500 psig or more but usually in the range of 100 to 200 psig at a temperature restricted with within the range of 700° to 950° F. Start of run regeneration temperatures are usually kept adjacent the lower end of the temperature spread.

The hydrotreating operation of this invention contemplates processing a wide boiling range olefinic charge material comprising oxygenates and higher boiling waxy products of Fischer-Tropsch Synthesis. The oil charge may be restricted to boil in a relatively narrow boiling range of about 400° F up to about 850° F or a wide boiling range fraction within the range of about 300° F up to about 915° or 975° F may be processed. It may also be particularly restricted to boil within the range of 350 or 400 up to about 725° F.

The feed materials herein identified may be hydrotreated alone or in admixture with an olefinic product of catalytic polyerization boiling above 300° or 370° F and particularly the heavy boiling product thereof boiling up to about 600° F. Other sources of oils such as creosotes and phenols may also be hydrotreated before being a part of the products desired herein. When processing a Fischer-Tropsch Synthesis product boiling up to 975° F, it is important to maintain the reactant space velocity within the range of 0.5 to 5.0 V/V/hr and preferably 1 to 3 LHSV because of the coking tendency of the feed components boiling above 600° F.

In the combination of this invention, the product effluent of the hydrotreating operation is separated in a combination of steps to obtain water, gaseous material, a naphtha or gasoline fraction boiling below about 400° F and a light distillate fuel boiling below about 600° F. A high boiling fraction of the hydrotreating operation such as is identified in Table 2 below and comprising high boiling waxy material is recovered and processed by selective cracking to provide fuel oils of reduced pour point and a high octane gasoline product.

TABLE 2

| RECTIFIER BOTTOMS | |
|---|---|
| Boiling Range, ° F | Vol. % |
| 400–450 | 9.2 |
| 450–500 | 11.7 |
| 500–600 | 18.2 |
| 600–700 | 22.5 |
| 700–800 | 32.1 |
| 800 + Bottoms | 6.3 |
| | 100.0 |

In the combination of this invention, the separated relatively heavy hydrogenated product is generally a relatively rough cut fraction boiling from about 400°–600° F up to about 915° F. This high boiling hydrogenated product is thereafter selectively cracked with one of a special class of crystalline zeolite conversion catalyst represented by a ZSM5 crystalline zeolite conversion catalyst.

The selective cracking operation is maintained under conditions to particularly convert waxy paraffinic material to lower boiling components including gasoline as well as light and heavy fuel oils of lower freeze point than the feed charged. The hydrodewaxing operating conditions may include a liquid hourly space velocity between 0.5 to 5.0, a temperature between 500° and 900° F and an elevated pressure within the range of 200 psig pressure up to about 1000 psig of pressure. The product effluent of the crystalline zeolite selective cracking operation is recovered and separated in a suitable product recovery fractionation operation. The products of hydrotreating and selective cracking may be separated in one or more common, or separate, separation operation. Since, the gasoline product of the selective cracking step is a substantially higher octane product than the hydrotreated product, it is preferred to keep them separate.

The catalytic hydrodewaxing of the previously hydrogenated 350° F plus fraction by the selective cracking step of the combination operation is accomplished at a temperature preferably within the range of about 500° F up to about 850° F at a hydrogen partial pressure within the range of 200 to 500 psia.

The hydrogenated waxy fraction brought in contact with the special zeolite catalyst such as a ZSM5 crystalline zeolite distributed in an alumina, silica alumina or clay matrix converts the high pour normal and isoparaffins to high octane gasoline product of at least about 85 O.N. clear and fuel oil products of low pour characteristics. The special zeolite catalyst may be used alone or it may be promoted with a hydrogenation component. Hydrogenation components suitable for this purpose include a Group VIII metal such as nickel, platinum, palladium, rhodium, ruthenium and other known hydrogenation components.

It will be observed from the information presented herein that a yield shift may be had depending on the selected end point of the gasoline boiling range material. Thus, the gasoline end point may be selected from within the range of about 300° to about 430° F; the lower end point being selected when it is desired to increase the yield of fuel oils and/or develop a suitable jet fuel fraction from products of the combination operation. Also, in the combination of this invention, the pour point of materials boiling above about 650° F is sufficiently reduced for use as diesel fuel or a heavy fuel product.

The special zeolite catalysts referred to herein utilize members of a special class of zeolites exhibiting some unusual properties. These zeolites induce profound transformations of aliphatic hydrocarbons to aromatic hydrocarbons in commercially desirable yields and are generally highly effective in alkylation, isomerization, disproportionation and other reactions involving aromatic hydrocarbons. Although they have unusually low alumina contents, i.e. high silica to alumina ratios, they are very active. This activity is surprising since catalytic activity of zeolites is generally attributed to framework aluminum atoms and cations associated with these aluminum atoms. These zeolites retain their crystallinity for long periods in spite of the presence of steam even at high temperatures which induce irreversible collapse of the crystal framework of other zeolites, e.g. of the X and A type. Furthermore, carbonaceous deposits, when formed, may be removed by burning at higher than usual temperatures to restore activity. In many environments, the zeolites of this class exhibit very low coke forming capability, conductive to very long times on stream between burning regenerations.

An important characteristic of the crystal structure of this class of zeolites is that it provides constrained access to, and egress from, the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon of aluminum atoms at the centers of the tetrahedra. Briefly, the preferred zeolites useful as catalysts in this invention possess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other forms within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The zeolites useful as catalysts in this invention freely sorb normal hexane and have a pore dimension greater than about 5 Angstroms. In addition, their structure must provide constrained access to some larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is substantially excluded and the zeolite is not of the desired type. Zeolites with windows of 10-membered rings are preferred, although excessive puckering or pore blockage may render these zeolites substantially ineffective. Zeolites with windows of twelve-membered rings do not generally appear to offer sufficient constriant to produce the advantageous conversions desired in the instant invention, although structures can be conceived, due to pore blockage or other cause, that may be operative.

Rather than attempt to judge from crystal structure whether or not a zeolite possesses the necessary constrained access, a simple determination of the "constraint index" may be made by continuously passing a mixture of equal weight of normal hexane and 3-methypentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F for at least 15 minutes. The zeolite is then flushed with helium and the temperature adjusted between 550° F and 950° F to give an overall conversion between 10% and 60%. The mixture of hydrocarbons is passed at 1 liquid hourly space velocity (i.e., 1 volume of liquid hydrocarbon per volume of catalyst per hour) over the zeolite with a helium dilution to give a helium to total hydrocarbon mole ratio of 4:1. After 20 minutes on steam, a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. Catalysts suitable for the present invention are those which employ a zeolite having a constraint index from 1.0 to 12.0. Constraint Index (CI) values for some typical zeolites including some not within the scope of this invention are:

| CAS | C.I. |
|---|---|
| ZSM-5 | 8.3 |
| ZSM-11 | 8.7 |
| ZSM-35 | 4.5 |
| TMA Offretite | 3.7 |
| ZSM-12 | 2 |
| ZSM-38 | 2 |
| Beta | 0.6 |
| ZSM-4 | 0.5 |
| Acid Mordenite | 0.5 |
| REY | 0.4 |
| Amorphous Silica-Alumina | 0.6 |
| Erionite | 38 |

The above-described Constraint Index is an important and even critical, definition of those zeolites which are useful to catalyze the instant process. The very nature of this parameter and the recited technique by which it is determined, however, admit of the possibility that a given zeolite can be tested under somewhat different conditions and thereby have different constraint indexes. Constraint Index seems to vary somewhat with severity of operation (conversion). Therefore, it will be appreciated that it may be possible to so select test conditions to establish multiple constraint indexes for a particular given zeolite which may be both inside and outside the above defined range of 1 to 12.

Thus, it should be understood that the "Constraint Index" value as used herein is an inclusive rather than an exclusive value. That is, a zeolite when tested by any combination of conditions within the testing definition set forth herein above to have a constraint index of 1 to 12 is intended to be included in the instant catalyst definition regardless that the same identical zeolite tested under other defined conditions may give a constraint index value outside of 1 to 12.

The class of zeolites defined herein is exemplified by ZSM-5, ZSM-11, ZSM-12, ZSM-21, ZSM-35, ZSM-38 and other similar material. Recently issued U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

U.S. application, Ser. No. 358,192, filed May 7, 1973, and now abandoned, the entire contents of which are incorporated herein by reference, describes a zeolite composition, and a method of making such, designated as ZSM-21 which is useful in this invention.

U.S. application Ser. No. 528,061 filed Nov. 29, 1974, the entire contents of which are incorporated herein by reference, describes a zeolite composition including a method of making it. This composition is designated ZSM-35 and is useful in this invention.

U.S. application Ser. No. 528,060, filed Nov. 29, 1974, and now abandoned, the entire contents of which are incorporated herein by reference, describes a zeolite composition including a method of making it. This composition is designated ZSM-38 and is useful in this invention.

The x-ray diffraction pattern of ZSM-21 appears to be generic to that of ZSM-35 and ZSM-38. Either or all of these zeolites is considered to be within the scope of this invention.

The specific zeolites described, when prepared in the presence of organic cations, are substantially catalytically inactive, possibly because the intracrystalline free space is occupied by organic cations from the forming solution. They may be activated by heating in an inert atmosphere at 1000° F for 1 hour, for example, followed by base exchange with ammonium salts followed by calcination at 1000° F in air. The presence of organic cations in the forming solution may not be absolutely essential to the formation of this special type zeolite; however, the presence of these cations does appear to favor the formation of this special type of zeolite. More generally, it is desirable to activate this type zeolite by base exchange with ammonium salts followed by calcination in air at about 1000° F for from about 15 minutes to about 24 hours.

Natural zeolites may sometimes be converted to this type zeolite by various activation procedures and other treatments such as base exchange, steaming, alumina extraction, and calcination, alone or in combinations. Natural minerals which may be so treated include ferrierite, brewsterite, stilbite, dachiardite, epistilbite, heulandite and clinoptilolite. The preferred crystalline aluminosilicates are ZSM-5, ZSM-11, ZSM-12, and ZSM-21, with ZSM-5 particularly preferred.

The zeolites used as catalysts in this invention may be in the hydrogen form or they may be base exchanged or impregnated to contain ammonium or a metal cation complement. It is desirable to calcine the zeolite after base exchange. The metal cations that may be present include any of the cations of the metals of Groups I through VIII of the periodic table. However, in the case of Group IA metals, the cation content should in no case be so large as to substantially eliminate the activity of the zeolite for the catalysis being employed in the instant invention. For example, a completely sodium exchanged H-ZSM-5 appears to be largely inactive for shape selective conversions required in the present invention.

In a preferred aspect of this invention, the zeolites useful as catalysts herein are selected as those having a crystal framework density, in the dry hydrogen form, of not substantially below about 1.6 gram per cubic centimeter. It has been found that zeolites which satisfy all three of these criteria are most desired. Therefore, the preferred catalysts of this invention are those comprising zeolites having a constraint index as defined above of about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of article on Zeolite Structure by W. M. Meier. This paper, the entire contents of which are incorporated herein by reference, is included in "Proceedings of the Conference on Molecular Sieves, London, April 1967" published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolite is associated with its high crystal anionic framework density of not less than about 1.6 grams per cubic centimeter. This high density of course must be associated with a relatively small amount of free space within the crystal, which might be expected to result in more stable structures. This free space, however, seems to be important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

DISCUSSION OF SPECIFIC EMBODIMENTS

FIG. I is a diagrammatic block flow arrangement of elevation in a processing arrangement comprising hydrotreating and selective cracking to upgrade light and heavier oil products of Fischer-Tropsch Synthesis in the presence of similarly formed oxygenates.

FIG. II is a diagrammatic sketch in elevation of the hydrotreating unit represented by zone 6 in FIG. I.

Referring now to the drawing, a Fischer-Tropsch Synthesis product fraction comprising light and heavier oil product in admixture with oxygenates formed by the reduction of carbon monoxide is recovered as a product fraction. This product fraction may be of narrow or wide boiling range as discussed above. In this specific example a wide boiling range product, boiling within the range of 300° to 975° F and more usually above 350° F is recovered and introduced to the process as by zone 2. The synthetic light and heavier oil products with entrained oxygenates is passed by conduit 4 to a hydrotreating unit or zone 6. Heavy gasoline product of catalytic polymerization boiling above about 370° F and obtained from zone 8 may be passed by conduit 10 for admixture with the light and heavier oil feed in conduit 4. Make up hydrogen for the hydrogenation operation in hydrotreating zone 6 is obtained from zone 12 by conduit 14. The hydrogenation operation accomplished by hydrotreating zone 6 is a relatively mild hydrogenation operation wherein oxygenates are converted to a hydrocarbon and olefins are hydrogenated. However, as emphasized herein; it is important to a successful hydrogenation operation because of the oxygenates in the feed to maintain the catalyst in a sulfided condition by the addition of a compound of sulfur in an amount in excess of that provided by the synthetic oil feed. Thus, it has been found that the mild hydrogenation conditions of the hydrotreating steps are such that significant desulfurization of the feed is not particularly effected. Generally, the hydrotreating conditions are maintained at a temperature within the range of 450° to 850° F and a pressure within the range of 300 to 1200 psig. The exothermic nature of the reaction is restricted to not more than about 75° across each bed of catalyst in the reactor and not more than about 250° F degrees between the reactor inlet and the reactor outlet. Details of the hydrotreater and its method of operation are more particularly discussed below.

The effluent of the hydrotreating operation is conveyed by conduit 16 to a heavy oil separation zone 18. In zone 18, a separation is made to roughly recover a heavy oil product from gasoline and lower boiling component. Separation zone is maintained at a temperature of about 600° F and a pressure of about 800 psig. An overhead fraction is recovered from zone 18 by conduit 20 for passage to a lower temperature separator 22 maintained at a temperature of about 150° F and a pressure of about 800 psig. A hydrogen rich recycle gaseous stream is recovered from separator 22 by conduit 24. A liquid product separated in separator 22 is passed by conduit 26 to a product fractionator 28. In a product fractionation system, a separation is made to recover low pressure off gas withdrawn by conduit 30 and passed to off gas recovery zone 32. A gasoline product of hydrotreating is recovered by conduit 34 and a light fuel oil or light diesel oil is recovered by conduit 36.

An oil product of hydrotreating of desired boiling range is recovered from separator 18 by conduit 38 for passage to a selective cracking operation in zone 40. The hydrotreated product in conduit 38 will comprise in a specific embodiment materials boiling within the range of 400° to 975° F. The selective cracking operation effected in zone 40 is accomplished at a temperature within the range of 550° to 770° F and at a hydrogen pressure of 200 to 600 psig. The selective cracking operation of this invention is accomplished with a ZSM5 crystalline zeolite conversion catalyst in the presence of hydrogen in a specific embodiment. The operation is sufficiently mild to produce aromatics by cyclization of formed olefins and produce hydrodewaxed diesel fuel product of at most 30° F pour point. The severity of the selective cracking-hydrodewaxing operation may be varied to optimize the yield of high octane gasoline product or the yield of fuel oil product of varying pour point. The product of the selective cracking operation is passed by conduit 42 to a low temperature separator 44 maintained at a temperature withing the range of 70° to 160° F and a pressure within the range of 200 to 600 psig.

A high pressure gaseous material is recovered from separator 44 by conduit 46 with a liquid product recovered by conduit 48. The liquid product in conduit 48 is passed to a product fractionator 50 maintained at a bottoms temperature in the range of 500° to 750° F and a pressure in the range of 15 to 75 psig wherein a separation is made to recover low pressure gas withdrawn by conduit 52 for passage to zone 32. A high octane gasoline fraction is recovered by conduit 54. Material higher boiling than gasoline is withdrawn by conduit 56 for passage to a vacuum tower 58.

The vacuum tower 58 maintained at a bottoms temperature within the range of 500° to 750° F and a pressure within the range of 50 to 350 mm/Hg separates a medium fuel oil product withdrawn by conduit 60 from a heavy diesel fuel recovered by conduit 62.

The processing combination above discussed is amenable to the recovery of a jet fuel boiling product from fractionator 28 by conduit 70. On the other hand, hydrogen rich gases suitable for recycle and use in the process may also be recovered. For example, a portion of a hydrogen rich gas stream recovered from low temperature separator 44 by conduit 46 may be recycled by conduit 66 for admixture with hydrogen rich gas in conduit 24. On the other hand, a portion of the hydrogen rich gas stream recovered from separator 22 by conduit 24 may be recycled by conduit 68 for admixture with make up hydrogen introduced by conduit 14 to the hydrotreating step in zone 6.

Referring now to FIG. II, there is shown in quite detail the hydrotreating reactor arrangement and a downstream heavy oil separator arrangement particularly relied upon in the processing arrangement of FIG. I. The hydrotreating operation is a relatively mild operation as discussed above for hydrogenating a light and heavier oil product of Fischer-Tropsch Synthesis and comprising in a particular embodiment oxygenates formed therein. In the arrangement of FIG. II, an oil feed comprising oxygenates is introduced to the process by conduit 2 after indirect heat exchange in process equipment not shown to raise the temperature thereof to about 470° F. The preheated feed is admixed with hydrogen rich make up gas alone or in combination with recycle hydrogen rich gas introduced by conduit 4. The preheated mixture is then passed to furnace 6 wherein the charge mixture is raised to an elevated temperature within the range of about 550° F up to about 675° F depending on whether it is the beginning or the end of the processing cycle. It is important during preheating of the feed mixture to limit vaporization thereof not to exceed about 85% vaporization to prevent fouling and plugging of the furnace tubes due to polymerization of the olefinic and/or di-olefinic hydrocarbons contained therein. Further, some hydrogen rich gas may be added to the feed upstream of the furnace to help reduce or minimize fouling of the furnace tubes or coils and effect a regulation of the temperature therein so that preferably from about 15 to 25 percent by weight of the feed is retained in the liquid phase during the heating step. Thus, the hydrogen requirements of the hydrogenation operation particularly desired are provided in part by admixture of hydrogen containing gas with the feed in the preheating step to achieve reactor inlet temperature and thereafter hydrogen containing quench gas is used in the reactor system as hereinafter particularly discussed. The preheated feed comprising hydrogen is thereafter passed by conduit 8 to the hydrogenation reaction zone 10. Additional hydrogen containing recycle gas may be introduced by conduit 12 and admixed with the feed in conduit 8. Hydrogen rich gas is mixed with the feed in amounts sufficient to provide a hydrogen partial pressure at the reactor inlet of at least 250 psia and that for the reactions which occur in the beds of catalyst initially encountered in the hydrotreating zone 10.

Hydrotreating zone 10 is a reaction zone provided with a plurality of separate, spaced apart, and sequentially arranged beds of catalyst A, B, C, and D. The catalyst beds may all be of the same depth or the upper most bed first contacted may be relatively shallow bed of catalyst with downstream catalyst beds being progressively thicker in the direction of reactant flow to assist with controlling the exothermicity of the hydrotreating operation. The catalyst beds may be housed in one or more separate reactor vessels and there may be more beds of catalyst than shown in the drawing. The depth of the hydrotreating catalyst in a catalyst bed and the space between beds for introducing quench gas as herein provided are arranged to cooperatively restrict the exothermic temperature gain in the separate catalyst sections within desired limits. The high olefinicity of the feed will promote a relatively high exothermic heat release and conversion of oxygenates in the feed will also contribute to this heat release. Thus, a delta temperature increase ($\Delta T$) not to exceed about 75° F in each catalyst bed and between the inlet and outlet of the reaction zone is desirable to produce more isothermal reaction behavior.

The hydrotreating operation will vary over a considerable temperature spread or range depending upon the condition of the catalyst employed. For example, it is contemplated using a start of run (SOR) temperature of about 550° F at the reactor inlet. On the other hand, the end of run (EOR) reactor inlet temperature may be about 675° F or within the range of 650° to 700° F. As mentioned above, it is also important to the hydrotreating operation of this invention to maintain the catalyst in a sulfided condition and under a hydrogen partial pressure which is preferably at least 250 psia and more usually at least about 625 psia. The overall space velocity employed may be selected from within the range of 0.5 up to about 5 LHSV depending upon the composition of the feed charged, its boiling range, and the condition of the catalyst for effecting the reactions desired. Maintaining the catalyst in a sulfided condition is accomplished by presulfiding the catalyst as mentioned above and by the continuous addition of a compound of sulfur to the feed charged to the reaction zone. In the arrangement of the drawing, this may be accomplished by adding the sulfur compound by conduit 14.

It has been found when processing a product of Fischer-Tropsch Synthesis boiling above 300° F and comprising oxygenates that sulfur in the charge amounting to about 40 ppm sulfur is not enough to keep the catalyst in a sulfided condition. The oxygenates in the feed remove the sulfur and oxidize the catalyst. Therefore, to compensate this undesired effect, sulfur is added to the charge in an amount sufficient to retain the catalyst in a sulfided condition and provide about 250 ppm of sulfur in the off gas recovered from the hydrogenation reactor effluent as hereinafter provided. The sulfided condition of the catalyst during onstream operation may be monitored by determining the bromine number of the hydrogenated effluent. The bromine number of the hydrotreated effluent jumps to a higher value when sulfur is lost from the catalyst and thereby renders the quality of diesel fuel product and also feed to the subsequent selective cracking operation unacceptable.

The hydrogenation reactor or hydrotreating reactor may be provided with an upstream guard chamber separate from the reactor or the material charged to the guard chamber may be distributed as a bed of material within and adjacent to the hydrotreating reactor inlet. For example, the upper most bed of particulate material may be alumina used to remove catalyst fines and iron scale in the feed material passed to the reactor. An activated alumina guard layer will also convert and remove soluble metal compounds in the feed. Thus, in reactor 10, the upper bed "A" is a bed of alumina particulate material with the remaining or more catalyst beds, B, C, and D comprising the hydrogenation catalyst.

The hydrotreating reactor temperature is controlled within the limits above specified by a cooperative control over the exothermic temperature gain allowed in each catalyst bed by control of the reactant space velocity, amount of catalyst contacted and by the use of cool quench gas introduced preferably between catalyst beds. Thus, a hydrogen rich recycle gas recovered from the process as identified in FIG. I may be recycled in part to the reactor 10 as by conduit 16 communicating with branched conduits 18, 20, and 22.

The effluent of the hydrotreating operation is recovered by conduit 24, cooled in cooler 26 to a temperature of about 675° F by indirect heat exchange with recycled hydrogen rich gas and then passed by conduit 28 to cooler 30 wherein its temperature is further reduced to about 625° F. The cooled effluent is passed by conduit 32 to separator drum 34 maintained at a temperature of about 625° F and a pressure of about 800 psig. Cooler 30 may be by-passed by conduit means 36.

An overhead product is withdrawn from separator 34 by conduit 38 for passage to a low temperature separator such as separator 22 of FIG. I. The material withdrawn by conduit 38 generally will boil below about 400° F. A heavy hydrogenated product stream boiling generally above 400°-600° F is withdrawn from the bottom of separator 34 by conduit 40 for passage to the DSC unit 40 of FIG. I.

Having thus generally discussed the processing combination of this invention and specifically described specific embodiments relating thereto, it is to be understood that no undue restrictions are to be imposed by reasons thereof except as defined by the following claims.

We claim:

1. A method for upgrading products of Fischer-Tropsch Synthesis boiling above 300° F comprising hydrocarbons and oxygenates which comprises:

hydrotreating the synthesis product boiling above 300° F in the presence of added sulfur component to provide up to 250 ppm sulfur in the feed and under conditions to catalytically convert oxygenates to hydrocarbons and saturate olefins in the synthesis product, separating a hydrogenated product of said hydrotreating to recover a relatively high boiling hydrocarbon fraction comprising material boiling above 400° F from a lower boiling fraction, separating the lower boiling fraction to recover a hydrogen rich gas stream, a gasoline product stream and a light diesel boiling range material, selectively cracking said high boiling hydrocarbon fraction with a catalyst comprising a crystalline zeolite selective for the purpose intended at a temperature within the range of 550° to 770° F and a hydrogen pressure of at least 200 psia, separating the product of said selective cracking to recover a hydrogen rich gas stream suitable for recycle to said cracking step, a low pressure gaseous product, a gasoline product of higher octane rating than recovered from said hydrotreating step and a bottoms product fraction higher boiling than said gasoline fraction and further separating said bottoms product fraction to recover a medium fuel oil fractions separate from a heavy diesel product.

2. The method of claim 1 wherein hydrotreating the synthesis product is accomplished with a sulfided catalyst maintained by the continuous addition of a sulfur compound with the feed to the hydrotreating step.

3. The method of claim 1 wherein a hydrogen rich gas recovered from the hydrotreated product is recycled to the hydrotreating zone.

4. The method of claim 1 wherein the gasoline product of said selective cracking operation is of a higher octane rating than the gasoline product separated from the hydrotreating operation and are recovered in separate fractionation zones.

5. The method of claim 1 wherein a hydrogen rich gas recovered from the product effluent of the selective cracking operation is recycled to the selective cracking step.

6. The method of claim 1 wherein the bottoms product fraction obtained from the selective cracking product effluent is further separated by vacuum distillation.

7. The method of claim 1 wherein a low pressure off gas is recovered separately from the product effluent of each of said hydrotreating step and said selective cracking step.

8. A method for hydrotreating a product of Fischer-Tropsch Synthesis boiling above 300° F comprising olefins and oxygenates which comprises admixing a product a Fischer-Tropsch Synthesis boiling above 300° F with hydrogen and heating the mixture under conditions to limit vaporization thereof not to exceed about 85% passing the heated feed sequentially through a plurality of separately arranged catalyst beds of hydrogenating catalyst maintained in a sulfided condition by the addition of a sulfur compound with the feed and under a hydrogen partial pressure of at least 200 psia, restricting the exothermic temperature gain in any one bed of catalyst not to exceed about 75° F, charging a cool hydrogen rich gas stream between catalyst bed, as quench gas to the reactant stream passing from one catalyst bed to another and separating the product of said hydrotreating operation to recover a product comprising gasoline and lower boiling components from a higher boiling hydrogenated fraction boiling generally above said gasoline boiling product.

9. The method of claim 8 wherein the preheated feed is initially passed through a bed of particulate material before contact with active hydrogenation catalyst for the purpose of removing catalyst fines, particulate metal oxides, or sulfides, and soluble metals.

10. The method of claim 8 wherein the preheated feed is admixed with a compound of sulfur sufficient to maintain the hydrogenation catalyst in a sulfided condition during the hydrogenation of oxygenates and olefinic hydrocarbons.

11. The method of claim 8 wherein a hydrogen rich recycle gas is recovered from the product of the hydrotreating operation and said hydrogen recycle gas comprises at least 250 ppm sulfur.

12. The method of claim 8 wherein the sequentially arranged catalyst beds are housed in one or more reactor vessels with increase in bed thickness in the direction of reactant flow.

13. The method of claim 12 wherein provision is made for adding a quench gaseous stream to the reactant between beds of catalyst so as to limit the exothermic temperature gain across the plurality of catalyst beds not to exceed about 100° F.

14. The method of claim 8 wherein the hydrogenation catalyst comprises cobalt and molybdenum distributed in a matrix and said hydrogenation catalyst is presulfided prior to contact with said feed comprising olefins and oxygenates.

* * * * *

UNITED STATES PATENT AND TRADEMARK OFFICE

CERTIFICATE OF CORRECTION

PATENT NO. : 4,080,397

DATED : March 21, 1978

INVENTOR(S) : WALTER R. DERR, JOSEPH R. McCLERNON, STEPHEN J. McGOVERN and FRITZ A. SMITH It is certified that error appears in the above-identified patent and that said Letters Patent are hereby corrected as shown below:

Item [73] Assignee: "Mobile Oil Corporation" should be --Mobil Oil Corporation--.

| | |
|---|---|
| Column 2, line 25 | "product" should be --products--. |
| Column 3, line 56 | After "with" add --an--. |
| Column 3, line 61 | "with" should be --to--. |
| Column 5, line 48 | "conductive" should be --conducive--. |
| Column 6, lines 36 & 37 | "3-methypentane" should be --3-methylpentane--. |
| Column 9, line 26 | "of" should be --in--. |
| Column 9, line 27 | "in" should be --of--. |
| Column 11, line 61 | "catalyst" should be --catalysts--. |
| Column 14, line 21 (Claim 8) | After "85%" add --,--. |

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*